United States Patent [19]

Greenberger et al.

[11] Patent Number: 4,689,831

[45] Date of Patent: Sep. 1, 1987

[54] CONVERTIBLE GARMENT

[75] Inventors: Susan Greenberger; Kate B. Horwich, both of Westport, Conn.

[73] Assignee: Homebodies, Inc., Westport, Conn.

[21] Appl. No.: 879,452

[22] Filed: Jun. 27, 1986

[51] Int. Cl.[4] ..... A41B 1/00

[52] U.S. Cl. ..... 2/93; 2/94; 2/108; 2/115

[58] Field of Search ..... 2/94, 108, 114, 95, 2/115, 93

[56] References Cited

U.S. PATENT DOCUMENTS

| | | | |
|---|---|---|---|
| 4,302,850 | 12/1981 | Maeshima | 2/108 X |
| 4,389,735 | 6/1983 | McLaughlin | 2/94 |
| 4,404,687 | 9/1983 | Hager | 2/94 |
| 4,475,251 | 10/1984 | Hopkins | 2/94 |
| 4,476,587 | 10/1984 | Itoi | 2/94 |
| 4,497,071 | 2/1985 | Bell | 2/94 |
| 4,502,155 | 3/1985 | Itoi | 2/94 X |
| 4,563,777 | 1/1986 | Park | 2/94 X |

*Primary Examiner*—Doris L. Troutman
*Assistant Examiner*—Judith L. Olds
*Attorney, Agent, or Firm*—Cooper, Dunham, Griffin & Moran

[57] ABSTRACT

A garment which is converted into a carrying pack to be worn on an individual's back. The invention comprises a garment, a pocket on the side of the garment, and straps on the inside of the garment, the pocket being invertible such that the garment may be folded therein, forming a carrying bag and exposing straps which enable the carrying bag to be worn on an individual's back.

10 Claims, 10 Drawing Figures

CONVERTIBLE GARMENT

BACKGROUND OF THE INVENTION

Various outer garments exist which can be folded into a pouch located on the garment itself. These garments appeal mainly to hikers, campers, and other sportsmen who appreciate the convenience of a jacket or other outer garment which can be folded into a compact package and placed into a backpack, clipped to a belt, or carried easily by hand.

It has previously been recognized that it is desirable to have a garment which can be folded and then carried on one's back. The garment may become an extra bag to carry other items and is easier to carry because it hangs on one's back. Such a garment will not take up extra space, as do those garments which must be carried in another backpack or bag, and will not be as cumbersome as those which are held in the hand or clipped on a belt. However, the garments previously designed have been quite complicated and are not readily usable by children.

For example, U.S. Pat. No. 4,307,470 shows two separate articles of clothing formed from one which cannot be used as both at the same time. When in a jacket wearing mode, the garment has useless straps on the outside back, but no backpack. A pair of zippers are opened on the jacket back so that the jacket may be folded inside. The straps are then used so that the pack can be worn on the back.

In U.S. Pat. No. 4,389,735 there is shown a combined jacket and backpack. The backpack has multiple compartments. When one compartment is opened by a zipper, the jacket may be folded inside. A similar structure is shown in U.S. Pat. No. 4,563,777. It is difficult to convert these combination structures from one mode to another.

SUMMARY OF THE INVENTION

It is an object of the present invention to provide a garment which can be folded into a pocket and then carried on one's back.

It is a further object of the invention to provide a combination garment, such as a jacket, and backpack.

It is still another object of the invention to provide convertible pajamas, nightshirts and sleepers which may fold into a carrying bag.

It is yet another object of the invention to provide a convertible garment which includes a carrying bag in both a garment wearing mode and a backpack mode.

To these and other ends, the present invention contemplates a garment with a carrying pocket located on the back or front portion thereof. The garment has straps fastened into the side seams of garment. The garment has openings in the inside sleeve seam to enable the sleeve to be rolled up and tucked inside the garment. The garment may be pushed through the back portion of the pocket while the openings of the pocket are pulled around the garment, the result being that the pocket is turned inside-out with the garment packed inside. The straps are then positioned on the outside of the carrying bag. The carrying bag has an inside pocket and can be secured with fasteners located at the opening. The straps are placed around the shoulders, allowing the bag to be worn on an individual's back while still usable as a backpack.

The garment may be a jacket, or pajamas, nightshirt or sleeper. The garment may be provided with distinctive, decorative effects, shapes or forms that are especially attractive to children. The carrying bag is operative in both a garment wearing mode and a backpack mode.

DETAILED DESCRIPTION

Figure 2:
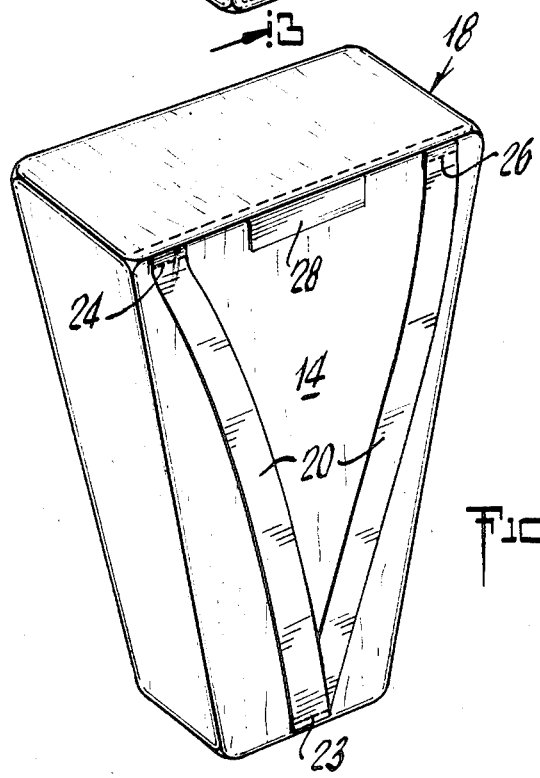
FIG. 2 is a back perspective view of the garment folded into the carrying bag.
Figure 3:
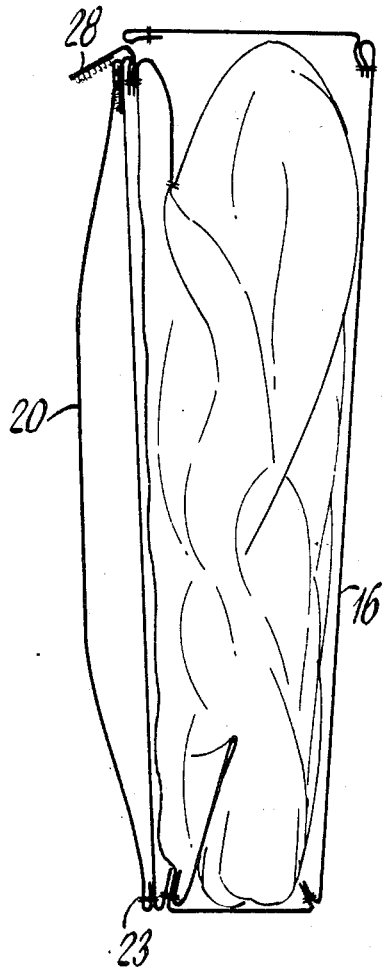
FIG. 3 is a cross sectional view along line 3—3 of FIG. 1.
Figure 4:
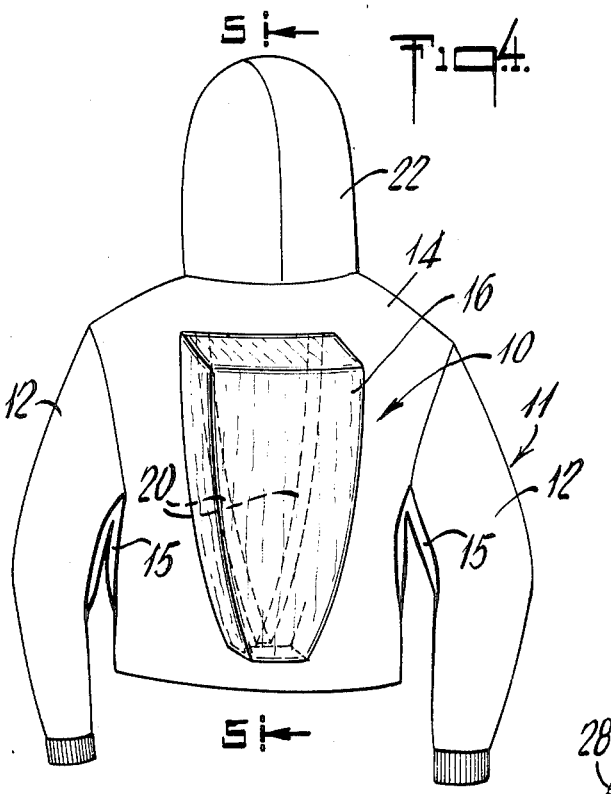
FIG. 4 is a back elevational view of a jacket in wearing mode.
Figure 5:
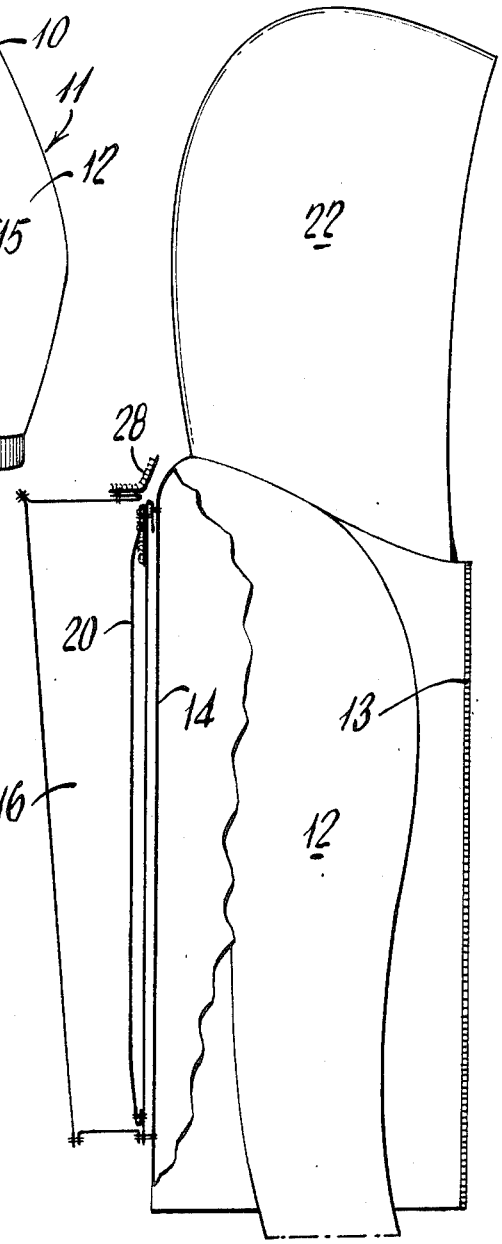
FIG. 5 is a cross sectional view along line 5—5 of FIG. 4.

As shown in the drawings of FIGS. 1–5, the invention is depicted as a jacket. As best seen in FIGS. 4 and 5, the garment 10 in wearing mode 11 has sleeves 12, front 13 and back 14. The sleeves 12 are partially attached to the front 13 and back 14 but there are open seams 14 on the top inside portion of the sleeves 12. A pocket 16 located on the back 14 of the garment is usable for carrying small items such as books or toys when the invention is in the garment wearing mode. The garment 10 has straps 20 sewn inside the back 14. The straps 20 are utilized only when the invention is in backpack mode and otherwise are hidden inside the garment when in wearing mode. The pocket 16 may also be located on the front of the garment 10. The garment 10 may be provided with a hood 22, but a hood is not required. The garment can have additional pockets on the front 13, but they also are not required. The garment 10 desirably has closure means on the front 13, which may be a zipper, buttons, snaps, hook-and-eye fasteners or other closure means.

It is a feature of the invention that the sleeves 12 may be rolled upwardly. They then may be tucked through the open seams and positioned under the shoulders of the garment. Thus, the garment is convertible into a short-sleeved garment.

Figure 1:
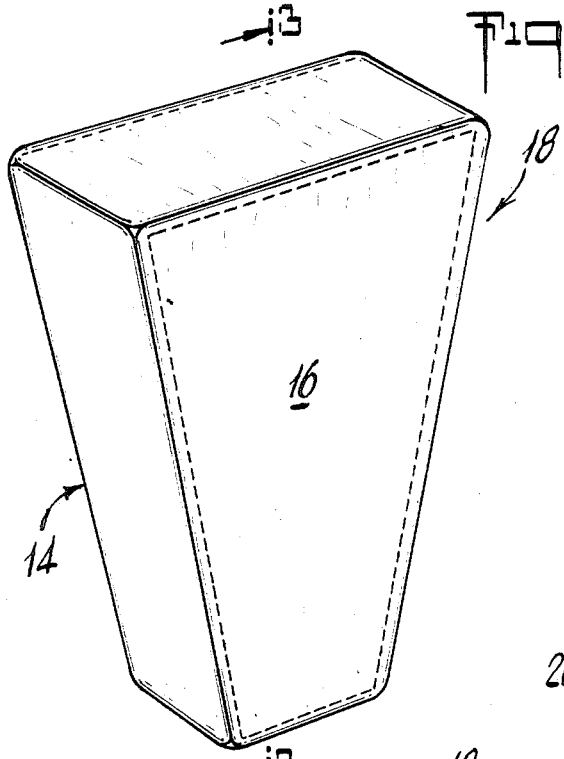
FIG. 1 is a front perspective view of a garment folded into a carrying bag.

FIGS. 1–3 depict the invention when converted into backpack mode 18. In that position, the inside of the back 14 becomes the outside of the backpack. When in the backpack mode 18, the convertible garment may also be used for carrying objects, although a portion of the interior of the backpack is filled with the folded garment. The straps 20 have their ends secured to the bottom of the pack at a common point 23 and at the top of the pack at two opposite corners 24 and 26, so as to form a V-configuration. The straps 20 are adapted to be placed over an individual's shoulders, enabling the pack to be worn on the individual's back. Closure means 28 may be used to secure the top of the pocket 16. The closure may be a zipper, buttons, snaps or hook-and-eye fasteners or other closure means.

In use, the garment 10 is converted into backpack mode (FIGS. 1 and 2) by opening the pocket 16 and pulling the bottom of the pocket out. This causes the pocket to be inverted inside-out and to form an inverted pocket. The remaining portions of the garment, including the hood 22 and sleeves 12 are stuffed inside the inverted pocket. It is not necessary to fold the garment in any specific manner. In that way, it may be converted even by a small child. Conversion forms a usable backpack with space over the garment for storage of items. The straps 20 which were inside the garment now are on the outside of the backpack 18. The straps 20 are located on the back of the backpack and are adapted to be worn over the shoulders. Closure means 28 are again located at the top of the backpack.

It is a particular feature of the invention that the convertible garment may be made in different forms, particularly as sleepwear. The garment may be converted into backpack mode in the same manner as described above.

Figure 6:
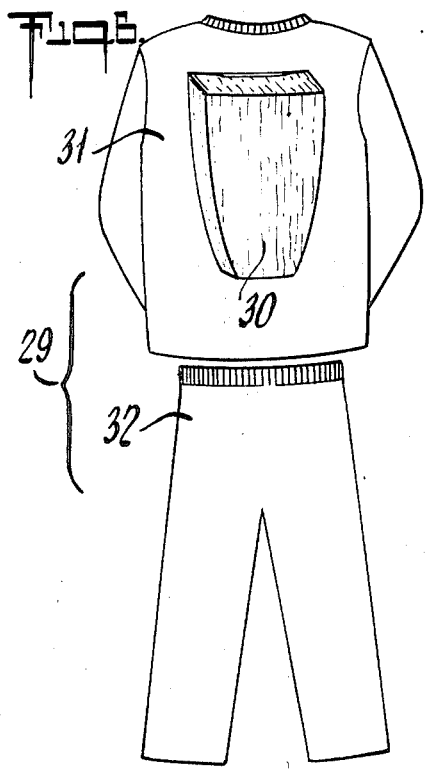
FIG. 6 is a back elevational view of two-piece pajamas in wearing mode.

FIG. 6 shows the invention in the form of convertible two-piece pajamas 29. The pocket 30 can be located on the back or the front of the shirt portion 31 of the pajamas. The straps inside the shirt are not visible in wearing mode. The pants portion 32 of the pajamas may be folded and placed into the backpack when the garment is converted into backpack mode.

Figure 7:
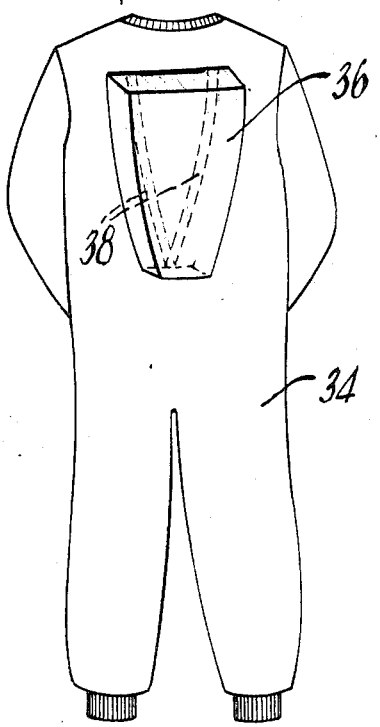
FIG. 7 is a back elevational view of a sleeper in wearing mode.

FIG. 7 shows the invention in another form of convertible one-piece pajamas 34. A pocket 36 for conversion into backpack mode, as previously described, may be on the front or back of the garment. The straps 38 are not visible in garment wearing mode.

Figure 8:
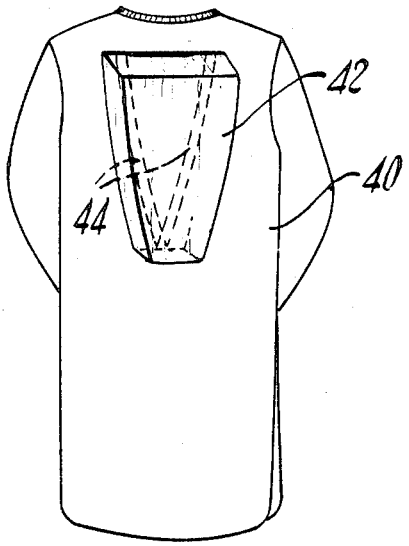
FIG. 8 is a back elevational view of a night shirt in wearing mode.

FIG. 8 shows the invention in another form of a convertible one piece nightshirt 40. The pocket 42 can be located on the front or the back of the garment. The straps 44, inside the garment are not visible in garment wearing mode.

Another feature of the invention is that it may be provided in various forms and shapes and with decorative elements, so that it appeals to children.

Figure 9:
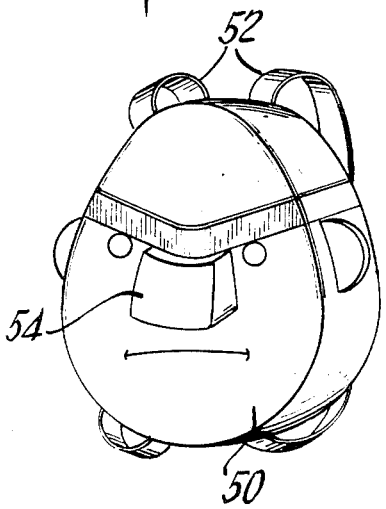
FIG. 9 is a perspective view of one embodiment of decorated carrying bag.
Figure 10:
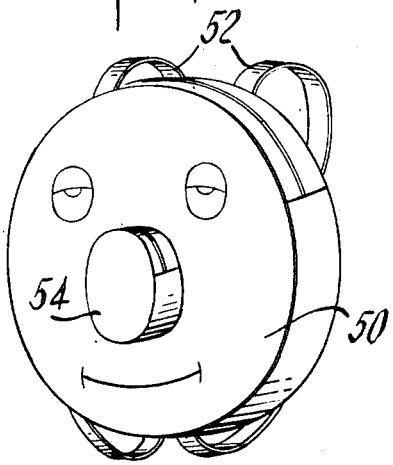
FIG. 10 is a perspective view of another embodiment of decorated carrying bag.

FIGS. 9 and 10 show two embodiments of the invention in backpack mode, with novel decorations 50 on the front and sides. The straps 52 are exposed and are fastened to the back of the backpack. The nose portion 54 of the face design may be an extra pocket, with a closure, for carrying small items.

The garment, whether a jacket, pajamas, nightshirt or sleeper, is desirably formed of a soft, pliable material, such as a knitted cotton material, a knitted fleeced material or lightweight woven materials. This permits the garment to be more easily converted into the backpack mode, even by a small child. It also permits the sleeves to be readily folded into the garment so that the garment may be converted into a short-sleeve or sleeveless version.

It should be appreciated that various modifications could be made in the structure of the convertible garment without departing from the spirit and scope of the invention. These modifications would be apparent to those having skill in the art.

We claim:

1. A convertible garment comprising a garment and a pocket on a side of the garment, the pocket being invertible such that the garment may be folded therein, thereby forming a carrying bag adapted to be worn on an individual's back.

2. A garment as defined in claim 1, wherein said garment is a jacket.

3. A garment as defined in claim 1, wherein said garment is a jacket with straps fastened to the inside, such that when the jacket is folded into the carrying bag, the straps are disposed on the outside of the bag and enable the bag to be worn on an individual's back.

4. A garment as defined in claim 1, wherein said garment is a one piece pajama.

5. A garment as defined in claim 1, wherein said garment is a one-piece pajama having straps fastened to the inside, such that when the garment is folded into the carrying bag, the straps are disposed on the outside of the bag and enable the bag to be worn on an individual's back.

6. A garment as defined in claim 1, wherein said garment is a night shirt.

7. A garment as defined in claim 1 wherein said garment is a night shirt with straps fastened to the inside, such that when the night shirt is folded into the carrying bag, the straps are disposed on the outside of the bag and enable the bag to be worn on an individual's back.

8. A garment as defined in claim 1, wherein said garment is a two-piece pajama.

9. A garment as defined in claim 1, wherein said garment is a two-piece pajama having straps fastened to the inside of the shirt portion of the garment, such that the entire garment can be folded into the carrying bag with said straps being disposed on the outside of the bag, enabling the bag to be worn on an individual's back.

10. A garment having a carrying pocket located on a back portion of the garment, and straps fastened at both ends inside the garment such that when the garment is pushed inside the pocket, the straps are disposed on the outside of the pocket, whereby a bag is formed which is adapted to be worn on an individual's back and to be held thereon by the straps.

* * * * *